US005623180A

United States Patent [19]

Jin et al.

[11] Patent Number: 5,623,180

[45] Date of Patent: Apr. 22, 1997

[54] ELECTRON FIELD EMITTERS COMPRISING PARTICLES COOLED WITH LOW VOLTAGE EMITTING MATERIAL

[75] Inventors: Sungho Jin, Millington; Gregory P. Kochanski, Dunellen; Wei Zhu, North Plainfield, all of N.J.

[73] Assignee: Lucent Technologies Inc., Murray Hill, N.J.

[21] Appl. No.: 332,179

[22] Filed: Oct. 31, 1994

[51] Int. Cl.[6] ..... H01J 1/30

[52] U.S. Cl. ..... 313/310; 313/309; 313/311; 313/336; 313/497; 427/77

[58] Field of Search ..... 313/310, 311, 313/309, 336, 351, 495, 497; 427/77

[56] References Cited

U.S. PATENT DOCUMENTS

| | | | |
|---|---|---|---|
| 4,008,412 | 2/1977 | Yuito et al. | 313/309 |
| 4,683,399 | 7/1987 | Soclof | 313/311 |
| 4,940,916 | 7/1990 | Borel et al. | 313/306 |
| 5,019,003 | 5/1991 | Chason | 313/309 |
| 5,129,850 | 7/1992 | Kane et al. | 445/24 |
| 5,138,237 | 8/1992 | Kane et al. | 315/349 |
| 5,258,685 | 11/1993 | Jaskie et al. | 313/309 |
| 5,278,475 | 1/1994 | Jaskie et al. | 313/311 |
| 5,283,500 | 2/1994 | Kochanski | 315/58 |
| 5,463,271 | 10/1995 | Geis et al. | 313/310 |
| 5,469,014 | 11/1995 | Itoh et al. | 313/311 |
| 5,475,280 | 12/1995 | Jones et al. | 313/309 |
| 5,504,385 | 4/1996 | Jin et al. | 313/309 |

FOREIGN PATENT DOCUMENTS

| | | |
|---|---|---|
| 0609532 | 8/1994 | European Pat. Off. . |
| 9522168 | 8/1995 | WIPO . |
| 9522169 | 8/1995 | WIPO . |

OTHER PUBLICATIONS

Dec. 1991 issue of *Semiconductor International*, p. 46+, Flat Panel Displays: What's All the Fuss About?.

C. A. Spindt et al. "Field–Emitter Arrays for Vacuum Microelectronics", *IEEE Transactions on Electron Devices*, vol. 38, pp. 2355–2363 (1991), No. 10, Oct. 1991.

J. A. Costellano, *Handbook of Display Technology* Academic Press, New York, pp. 254–257 (1992).

Okano et al. *Appl. Phys. Lett.* vol. 64, p. 2742 et seq. (1994). Fabrication of a diamond field emitter array., No. 20.

*Primary Examiner*—Sandra L. O'Shea
*Assistant Examiner*—Matthew J. Esserman
*Attorney, Agent, or Firm*—Glen E. Books

[57] ABSTRACT

The present invention provides methods and apparatus for making enhanced field emitters by coating particulate substrates with low voltage emissive material such as defect-rich diamond. These methods permit the advantageous, low-cost combination of low voltage emission with sharp-featured geometry.

8 Claims, 3 Drawing Sheets

ELECTRON FIELD EMITTERS COMPRISING PARTICLES COOLED WITH LOW VOLTAGE EMITTING MATERIAL

FIELD OF THE INVENTION

This invention concerns electron field emitters and, in particular, methods and apparatus for moving enhanced particulate field emitters.

BACKGROUND OF THE INVENTION

A field emission device emit electrons in response to an applied electrostatic field. Such devices be useful in a wide variety of applications including displays, electron guns and electron be lithography. A particularly promising application is the use of field emission devices in addressable ways to be flat panel displays. See, for example, the December 1991 issue of *Semiconductor International,* p. 11; C. A. Spindt et al., IEEE Transactions on Electron Devices, Vol. 38 (10), pp. 2355–63 (1991); and J. A. Costellano, *Handbook of Display Technology,* Academic Press, New York, pp. 254–57 (1992), all of which are incorporated herein by reference.

A typical field emission device comprises a cathode including a plurality of field emitter tips and an anode spaced from the cathode. A voltage applied between the anode and cathode induces the emission of electrons towards the anode.

Conventional electron emission flat panel displays typically comprise a flat vacuum cell having a matrix tray of microscopic field emitters tips formed on a cathode of the cell ("the back plate") and a phosphor-coated anode on a transparent front plate. Between cathode and anode is a conductive element called a "grid" or "gate". The cathodes and gates be typically intersecting slips (usually perpendicular slips) whose intersections define pixels for the display. A given pixel is activated by applying voltage between the cathode conductor slip and the gate conductor strip whose intersection defines the pixel. A more positive voltage is applied to the anode in order to improve a relatively high energy (400–1000 eV) to be emitted electrons. See, for example, U.S. Pat. Nos. 4,940,916; 5,129,850; 5,138,237; and 5,283,500, each of which is incorporated herein by reference.

Diamonds are desirable field emitters. Early field emitters were largely sharp-tipped structures of metal or semiconductor, such as Mo or Si cones. Such tips, however, are difficult to make, have insufficient durability for many applications and require a high voltage (about 100 V) to induce electron emission. Diamonds, however, have structural durability and can have negative electron affinity—properties that make them at&active for field emission devices. Field emission devices employing diamond field emitters are disclosed, for example, in U.S. Pat. Nos. 5,129,850 and 5,138,237 and in Okano et al, *Appl. Phys. Lett.*, Vol. 64, p. 2742 et seq. (1994), all of which are incorporated herein by reference. Flat panel displays which can employ diamond emitters are disclosed in co-pending Jin et al U.S. patent applications Ser. No. 08/299,674 and U.S. application Ser. No. 08/299,470, now U.S. Pat. No. 5,504,385 both filed Aug. 31, 1994, which are incorporated herein by reference.

Enhanced diamond emitters grown or treated to increase the concentration of defects and thereby enhance their low voltage emission are described in the concurrently-filed, co-pending U.S. patent application Ser. No. 08/331,458 of Jin et al entitled "Field Emission Devices Employing Enhanced Diamond Field Emitters." Defect-rich diamond material characterized by a broadened diamond peak at 1332 $cm^{-1}$ in Raman spectroscopy with a full width at half maximum (FWHM) in the range 5–15 $cm^{-1}$ can emit electrons in current density of at least 0.1 $mMmm^2$at a low applied field of 25 V/μm or less.

SUMMARY OF THE INVENTION

The present invention provides methods and apparatus for making enhanced field emitters by coating particulate substrates with low voltage emissive material such as defect-rich diamond. These methods permit the advantageous, low-cost combination of low voltage emission with sharp-featured geometry.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION

Figure 1:
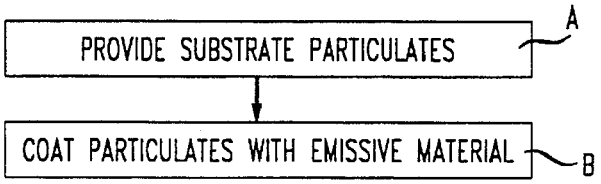
FIG. 1 is a schematic block diagram of the steps involved in making enhanced particulate field emitters in accordance with the invention.

Referring to the drawings, FIG. 1 illustrates the steps of the general process for making enhanced particulate field emitters. As shown in block A of FIG. 1, the first step is to provide substrate particulates.

The substrate particulates preferably have sharp-featured geometry (polyhedral, jagged, or faceted) for field concentration during electron emission. The particulates can be diamond grits, ceramic particles such as oxides, nitrides, or carbides (exemplary materials being, $Al_2O_3$, AlN, CuO, $YBa_2Cu_3O_x$, $La_{0.67}Ca8_{0.33}MnO_x$, WC), or semiconductor particles such as Si. The particles may be used as-made or pulverized into irregular or jagged geometry. Some electrical conductivity in the substrate particles is advantageous for passing the electrical current easily to the emitter tips, although conductivity is not an absolute requirement. Metal particles may also be used as the substrate particles. Refractory metals or carbide-forming metals such as molybdenum (Mo) are advantageous, especially since the nucleation of diamond is relatively easy on these substrates. The melting point of the substrate particles is preferably above 500° C. to avoid melting during subsequent coating, evacuation and glass sealing of the field emission apparatus. The desired range of the substrate particle diameters is 0.1–100 μm and preferably 0.2–5 μm. The desired sharpness of the particulate geometry is, in at least one location on each particle, less than 0.5 μm and preferably less than 0.1 μm in radius of curvature.

The next step shown in block B of FIG. 1 is to coat the substrate particles with low voltage emission material. Preferably, the particles are coated with a material emitting electrons at a current density of at least 0.1 $mA/mm^2$ at an applied field of 25 V/μm or less. The preferred low voltage emission material is defect-rich diamond, and the preferred method for coating is chemical vapor deposition (CVD) using carbonaceous gases such as $CH_4$, $C_2H_6$, $CH_3OH$ and CO either at temperatures lower than those typically recommended for producing high quality, low defect density diamonds or at concentrations of carbon in the CVD gas greater than the concentrations used for making low defect diamond. Typically, a mixture of $CH_4$ and $H_2$ is used. Using the first approach, the deposition temperature is maintained below 900° C. and preferably below about 800° C. so that a significant number of defects, such as $sp^2$ bonds, point defects, and amorphous phases, are incorporated into the $sp^3$—dominated diamond. Using the second approach, the atomic % of carbon atoms in the CVD gas mixture is kept greater than 0.5%, preferably greater than 1% and even more preferably greater than 2 atomic %. The desirable range of defect density can be expressed in terms of the broadening of the diamond peak at 1332 $cm^{-1}$ in Raman spectroscopy. Specifically, in defect-rich material, the peak has a full width at half maximum $\geqq 5$ $cm^{-1}$ preferably in the range 5–15 $cm^{-1}$ and even more preferably in the range 7–11 $cm^{-1}$. Alternatively, instead of coating defect-containing diamond, one can coat a thin film of n-type semiconducting diamond or other low voltage emission material such as semiconductive AlN or $LaB_6$.

Figure 2:
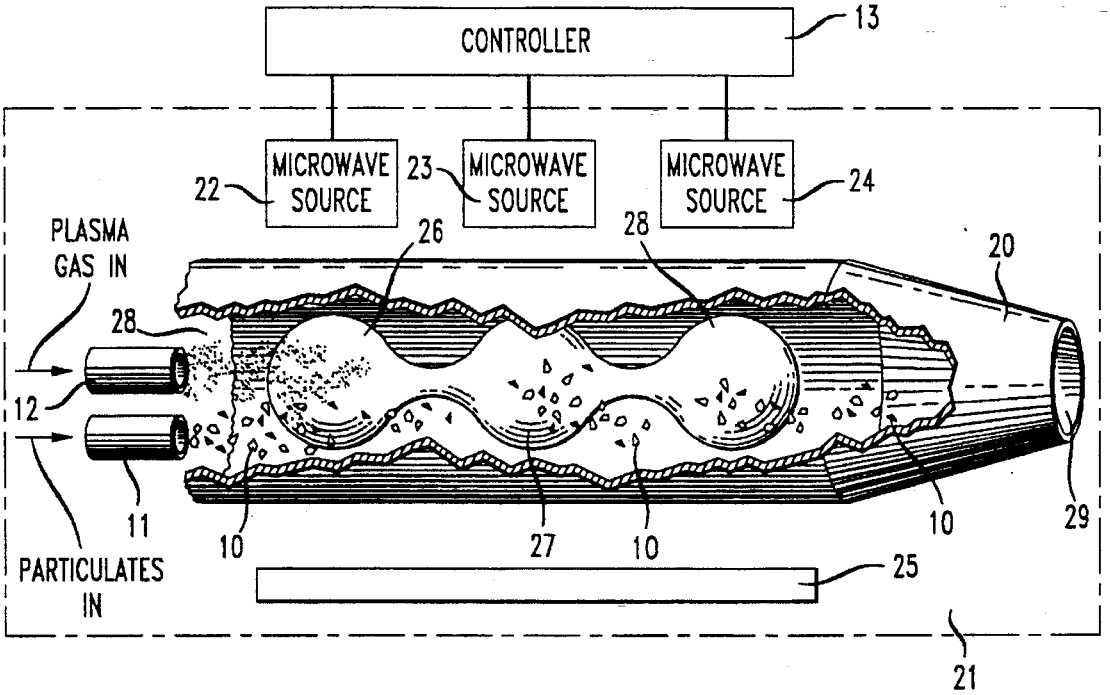
FIG. 2 schematically illustrates a first embodiment of apparatus useful in practicing the method of FIG. 1.
Figure 3:
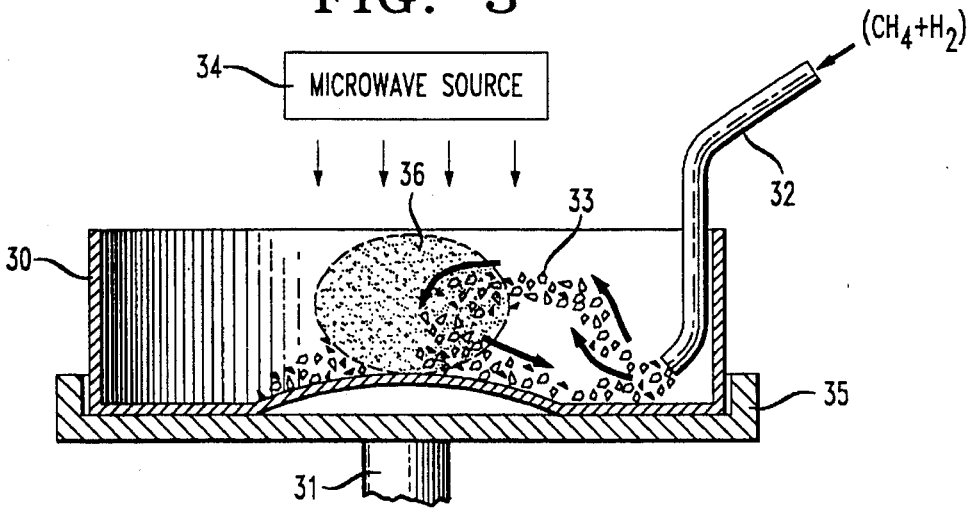
FIG. 3 illustrates a second embodiment of apparatus for practicing the method of FIG. 1.
Figure 4:
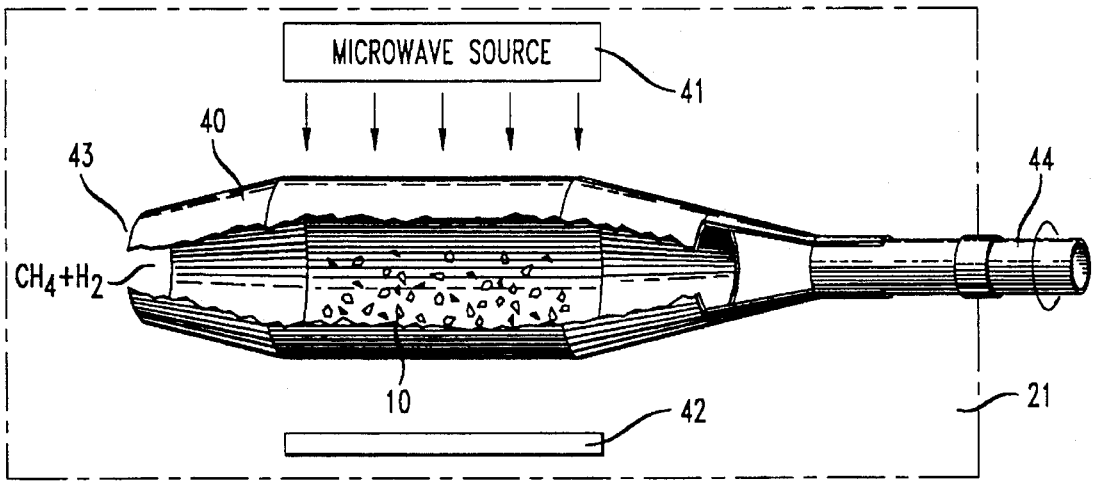
FIG. 4 schematically illustrates a third embodiment useful in practicing the method of FIG. 1.

In order to minimize agglomeration of the particulates and to make the coating uniform, it is desirable that the substrates be kept from continuous contact during the coating process so that fresh surfaces are exposed to the CVD environment and so that the particles do not sinter together. FIGS. 2, 3 and 4 show preferred apparatus for effecting coating while the particulates are prevented from continuous contact.

FIG. 2 is a schematic cross section of a first embodiment of apparatus for coating particulate substrates with low voltage diamond emissive material. A chamber 20 is advantageously constructed of microwave-transparent material such as fused quartz tube. A plurality of separately switchable microwave sources 22, 23 and 24 are disposed along the chamber, and a microwave reflector 25 is disposed so that sources 22, 23, and 24 produce adjacent plasma regions 26, 27 and 28 along the chamber. Opening 28 is provided in the chamber 20 to permit entry of particulate substrates 10 and the plasma gas mixture through tubes 11 and 12, respectively. Opening 29 permits their exit. A controller 13 is provided for selectively switching microwave sources 22, 23 and 24.

In operation, the chamber is placed within an evacuated low pressure container 21 and both the particulate substrates and the plasma gas mixture is flowed through. The chamber is heated to a desired temperature by radiation or other heating means (not shown). A plasma is ignited within the chamber by activating microwave sources 22, 23, 24. Movement and flow of the particulate substrates is achieved by selectively switching off the plasma regions 26, 27 and 28. The particulates 10 are typically electrostatically confined within the plasma regions. When plasma region 26 is switched off, as by switching off microwave source 22, the particulates in region 26 move to adjacent region 27. Similarly, when both 26 and 27 are switched off, the particulates move to region 28. With 27 off, switching off 28 returns control of the particulates in 28 to gravity and hydrodynamic forces, removing the particles from the plasma. Thus selective switching of the plasma sources can move particulate substrates through the plasma. Preferred operating conditions are temperature below 900° C. and a $CH_4/H_2$ plasma gas mixture with a methane concentration higher than 2 mole %. Gas pressure is typically 10–100 torr, and the microwave sources are about 1 KW.

FIG. 3 is an alternative embodiment where rotation of chamber 30 and the force of the CVD gas mixture assists in moving the particulates. Specifically, rotatable quartz chamber 30 within a CVD chamber (not shown) is rotated by shaft 31. The gas mixture is provided by one or more inlet tubes 32 preferably located at the periphery of chamber 30 for blowing particulates 33 toward the center of the chamber. The overall pressure is maintained by balancing injected gas with continuous pumping of the CVD chamber through a throttle valve (not shown). Microwave source 34 provides microwave energy to establish a plasma ball 36 at the center. (Alternatively, the source 34 can be a hot tungsten or tantalum filament which decomposes and activates the gases for deposition of diamond.) Centrifugal force extended on the particulates by rotating chamber 30 moves the particles outwards, while the gas blow force drives them back to the center where they are coated. Typical operating parameters are 1 KW of microwave power, gas pressure of 10–100 torr, and rotation at 100–10,000 r.p.m. If a hot filament is used, it should be in the temperature range 2000°–2300° C.

FIG. 4 is a schematic cross section of an alternative apparatus for microwave coating of particulates 10 comprising a longitudinally extending rotatable chamber 40 disposed within a CVD chamber 21. The CVD chamber is equipped with a microwave source 41 and a microwave reflector 42. The rotable chamber 40 is advantageously constructed of microwave-transparent material such as fused quartz and is preferably disposed between source 41 and reflector 42 so that a plasma is formed within chamber 40. Opening 43 is provided at the end of chamber 40 to permit the flow of a CVD gas mixture (preferably $CH_4$ and $H_2$), and the chamber is attached to a shaft 44 for rotation.

In operation, particulate substrates 10 are loaded into chamber 40. The CVD chamber 21 is evacuated, and the rotatable chamber 40 is rotated to tumble the particulates 10. The chamber 40 is heated to a desired high temperature preferably below 900° C. by radiative or other heating methods, and $CH_4/H_2$ mixture with carbon concentration preferably >0.5 atomic percent is flowed into chamber 40. The microwave power is then applied to coat the particulates. Typical operating parameters are 1 KW microwave power, gas pressure of 10–100 torr, and rotation at 10–10,000 rpm.

Instead of microwave or hot filament CVD, other techniques such as DC plasma jet or flame deposition can also be used to coat low voltage emissive material onto particulate substrates.

Figure 5:
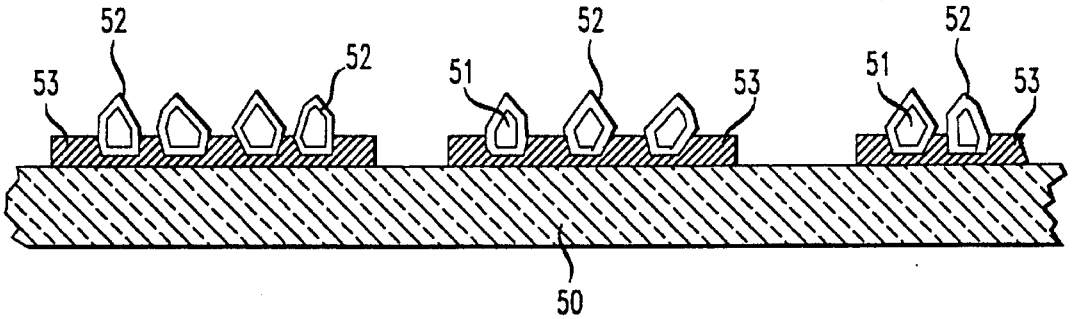
FIGS. 5–8 illustrate field emission devices using enhanced particulate field emitters.
Figure 6:
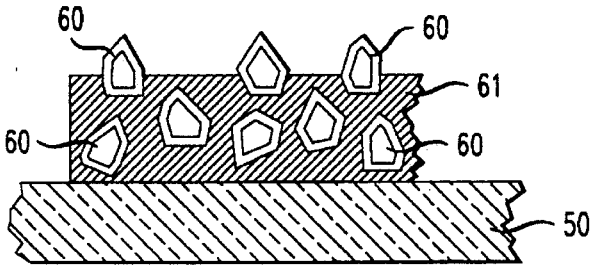

Coated particulates in low voltage field emission devices are illustrated in FIGS. 5–8. As shown in FIG. 5, the emissive particulates comprise a substrate 51 and a coating 52 of low voltage emissive material. Preferably, the particulates are used in a field emitter comprising a substrate 50, and one or more conductive bases 53 disposed on the substrate. Coated, emissive particulates are embedded or adhered to the conductive bases. The low voltage emissive coating is preferably defect-rich diamond as described above, but could also be AlN or $LaB_6$. As shown in FIG. 6, the coated, emissive particulates 60 can also be embedded in a matrix of conductive material 61 on the substrate 50.

Figure 7:
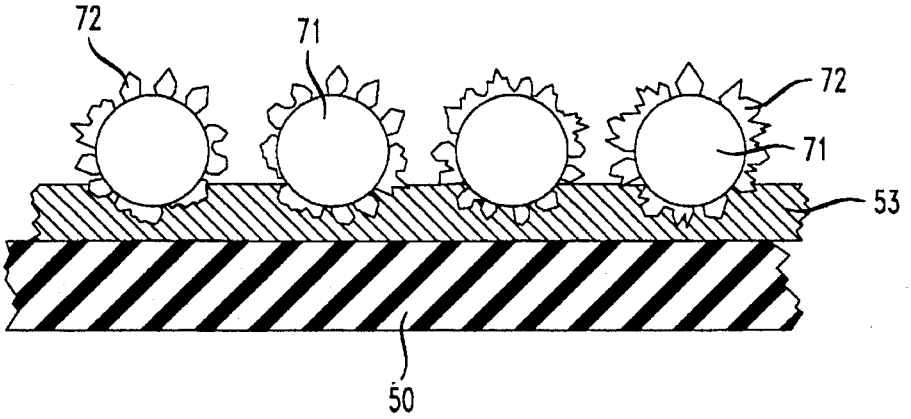
Figure 8:
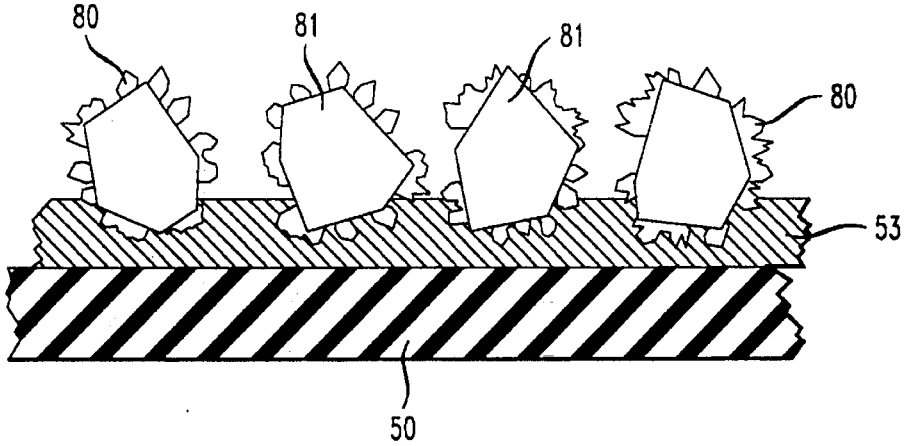

While the emissive coating 52 in FIGS. 5 and 6 is shown as a continuous coating, it can also be in the form of discontinuous islands with the advantage of providing emitting tips of smaller radius of curvature for enhanced field concentration. FIG. 7 illustrates an emitter comprised of such particulates comprising, for example, rounded Mo substrates 71 onto which a coating 72 of sharp-featured emissive diamond material has been nucleated. The desired sharpness of geometry for the electron emitting islands or films is at least, in one location on each island, less than 0.1 μm in radius of curvature. Since the substrate particulate is electrically conductive, the electron-emitting coating on the particulate need not be continuous. Alternatively, as illustrated in FIG. 8, the sharp-featured coating islands 80 can be nucleated on sharp-featured particulate substrates 81 such as semiconductive diamond grits.

The emitter structure of FIGS. 5-8 is easily fabricated after the particulates have been coated. The composite substrate particulates coated with low-voltage electron emitting film are then applied on the surface of the flat display substrate (such as glass plate) as an emitter array using convenient techniques such as screen printing or spray coating followed by patterning (e.g., into a row of 100 μm wide emitter stripes). Exemplarily, the coated particulates are mixed with a liquid medium (e.g., acetone, alcohol, water), optionally with organic binder (to be pyrolyzed later), and metal (e.g., high melting-point solder or alloy particles) or conductive oxide particles. After the mixture is spray coated or screen printed onto the flat surface, the structure is heated to melt the solder. As one alternative a conductive adhesive (such as silver-containing epoxy or polyimide) may be used as a screen printing liquid carrier for the electron-emitting particles. Some baking or heating procedure is desired to take out volatile components for high vacuum operation of the field emission devices. For additional exposure of buried emitter particles, slight surface etching, solvent dissolution, or mechanical polishing may be utilized.

As a second alternative suitable for sufficiently conductive particles, a few layers of particles may be adhered directly to the conductive surface by an adhesive layer whose volume is smaller than the volume of the emitter particles so that the particles are in direct contact with the substrate and each other. The adhesive is preferably a predominantly silica glass derived by hydrolysis of organosiloxanes, but it could also be finely pulverized bulk glass or an organic adhesive.

Yet another alternative approach is to mix emissive particulates with particles of low-melting-point glass (glass frits) and particles of conductive metals such as Ag or easily-reducible ceramic such as CuO (which can be reduced into metallic Cu by low-temperature heat treatment in a hydrogen-containing atmosphere). A slurry made up of these particles, some organic or inorganic binder, and solvent or water, is then spray coated or screen printed, followed by baking or heat treatment steps. The presence of the glass frit in the emitter stripes (especially if the glass frit has the same composition or at least one common oxide component as in the flat glass substrate) enhances the adhesion of the emitter stripes onto the substrate during the heat treatment. Other particle deposition techniques such as electrophoresis or electrostatic deposition of dry powders can be used.

Figure 9:
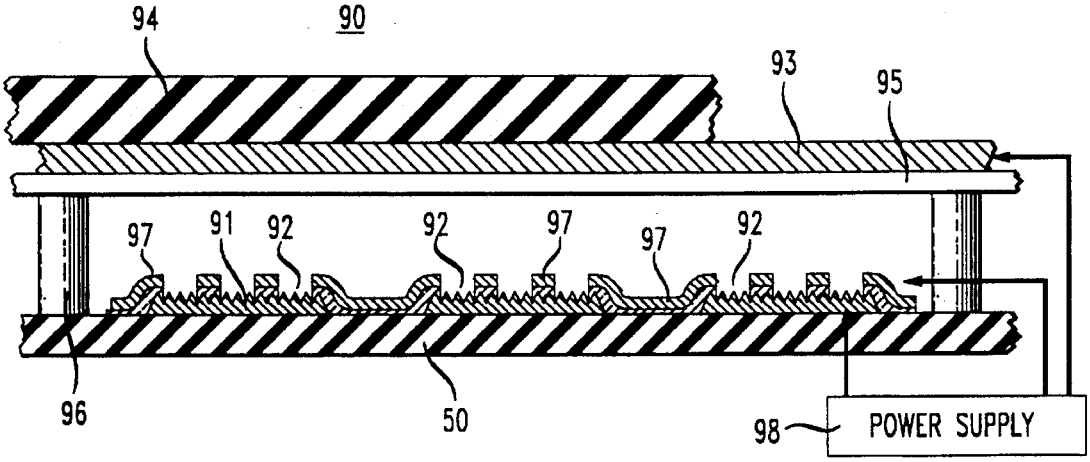
FIG. 9 is a schematic cross section of a field emission flat panel display using the low voltage field emission devices of FIGS. 5–8.

The preferred use of these low voltage particulate emitters is in the fabrication of field emission devices such as electron emission flat panel displays. FIG. 9 is a schematic cross section of an exemplary flat panel display 90 using low voltage particulate emitters. The display comprises a cathode 91 including a plurality of low voltage particulate emitters 92 and an anode 93 disposed in spaced relation from the emitters within a vacuum seal. The anode conductor 93 formed on a transparent insulating substrate 94 is provided with a phosphor layer 95 and mounted on support pillars 96. Between the cathode and the anode and closely spaced from the emitters is a perforated conductive gate layer 97.

The space between the anode and the emitter is sealed and evacuated, and voltage is applied by power supply 98. The field-emitted electrons from electron emitters 92 are accelerated by the gate electrode 97 from multiple emitters 92 on each pixel and move toward the anode conductive layer 93 (typically transparent conductor such as indium-tin-oxide) coated on the anode substrate 94. Phosphor layer 95 is disposed between the electron emitters and the anode. As the accelerated electrons hit the phosphor, a display image is generated.

It is to be understood that the above-described embodiments are illustrative of only a few of the many possible specific embodiments which can represent applications of the principles of the invention. For example, the low-voltage field emitters of this invention can be used not only for flat-panel display apparatus but for other applications, such as a x-y matrix addressable electron sources for electron lithography or for microwave power amplifier tubes. Thus numerous and varied other arrangements can be made by those skilled in the art without departing from the spirit and scope of the invention.

We claim:

1. A field emitter for emitting electrons at low voltage comprising:

a plurality of substrate particles having maximum dimensions in the range 0.1–100 μm;

each particle of said plurality coated with a layer of low voltage emitting material for emitting electrons at an applied field of 25 V/μm or less, said field emitter emitting a current density of at least 0.1 $mA/mm^2$, said low voltage emitting material comprising defect—containing diamond characterized by a diamond peak at 1332 $cm^{-1}$ in Raman spectroscopy broadened to a full width at half maximum $\geqq 5$ $cm^{-1}$.

2. A field emitter according to claim 1 wherein said low voltage emitting material comprises n-type semiconducting diamond.

3. A field emitter according to claim 1 wherein said substrate particles comprise particles of refractory material.

4. A field emitter according to claim 1 wherein said substrate particles comprise diamond particles.

5. A field emitter according to claim 1 wherein each coated substrate particle of said plurality includes at least one region having a radius of curvature less than 0.5 μm.

6. A field emitter according to claim 1 or 2 or 3 or 4 or 5 further comprising a planar substrate and a conductive layer for attaching said particles to said substrate and providing electrical contact to said particles.

7. In a field emission device comprising a cathode including at least one field emitter, an anode spaced from said cathode and means for applying a voltage between said anode and said cathode for inducing emission of electrons, the improvement wherein:

said field emitter comprises a field emitter according to claim 1 or 2 or 3 or 4 or 5.

8. In a flat panel field emission display comprising a vacuum cell having a back-plate, a transparent front plate, a cathode including a plurality of field emitters on the back-plate, a phosphor-coated anode on the front plate, and a conductive gate disposed between said anode and said cathode, the improvement wherein:

said field emitter cathode comprises a field emitter according to claim 1 or 2 or 3 or 4 or 5.

* * * * *